US006173256B1

(12) United States Patent
Gigi

(10) Patent No.: US 6,173,256 B1
(45) Date of Patent: Jan. 9, 2001

(54) METHOD AND APPARATUS FOR AUDIO REPRESENTATION OF SPEECH THAT HAS BEEN ENCODED ACCORDING TO THE LPC PRINCIPLE, THROUGH ADDING NOISE TO CONSTITUENT SIGNALS THEREIN

(75) Inventor: Ercan F. Gigi, Eindhoven (NL)

(73) Assignee: U.S. Philips Corporation, New York, NY (US)

( * ) Notice: Under 35 U.S.C. 154(b), the term of this patent shall be extended for 0 days.

(21) Appl. No.: 09/178,091

(22) Filed: Oct. 27, 1998

(30) Foreign Application Priority Data

Oct. 31, 1997 (EP) ..... 97203393

(51) Int. Cl.[7] ..... G10L 19/04; G10L 11/06

(52) U.S. Cl. ..... 704/219; 704/220; 704/226; 704/208

(58) Field of Search ..... 704/219, 220, 704/223, 228, 229, 226, 208

(56) References Cited

U.S. PATENT DOCUMENTS 4,969,192 * 11/1990 Chen et al. ..... 381/31
5,479,564 12/1995 Vogten et al. ..... 395/2.76
5,611,002 3/1997 Vogten et al. ..... 395/2.76
6,009,384 * 12/1999 Veldhuis et al. ..... 704/201

OTHER PUBLICATIONS

Alan V. McCree et al: "A Mixed Excitation LPC Vocoder Model for Low Bit Rate Speech Coding", in IEEE Trans. on Speech and Audio Processing, vol. 3, No. 4, Jul. 1995, pp. 242–250.

* cited by examiner

*Primary Examiner*—David R. Hudspeth
*Assistant Examiner*—Susan Wieland
(74) *Attorney, Agent, or Firm*—Daniel J. Piotrowski

(57) ABSTRACT

Speech is received as a sequence of segments that are coded according to an LPC principle. The segments are reproduced for concatenated read-out in audio reproduction, by exciting an all-pole filter with recurrent signals in case of voiced speech and by white noise in case of unvoiced speech. In particular, the recurrent signals are globally represented as an accumulated series of periodic signals on the basis of mutually overlapping time windows. The recurrent signals are supplemented by noise for filtering through an amended LPC filter derived from the original LPC-filter by using information of pitch and formants, and of a voiced-unvoiced dichotomy. The filter is determined as depending on at least a subset of the four quantities Global Noise Scaling, Pitch Dependent Noise Scaling, Amplitude Dependent Noise Scaling, and Inter-Formant Noise Scaling.

8 Claims, 12 Drawing Sheets

METHOD AND APPARATUS FOR AUDIO REPRESENTATION OF SPEECH THAT HAS BEEN ENCODED ACCORDING TO THE LPC PRINCIPLE, THROUGH ADDING NOISE TO CONSTITUENT SIGNALS THEREIN

BACKGROUND OF THE INVENTION

The invention relates to a method according to the preamble of claim 1. LPC coding has been in wide use for low-cost applications. Therefore, performance to some extent has been compromised. Such methods have often caused a kind of so-called buzzy-ness in the reproduced speech which is represented by certain unnatural sounds that may occur over the whole frequency range and that are experienced by listeners as annoying; the problem also appears in a spectrogram. The state of the art is represented by Alan V. McCree et al, A Mixed Excitation LPC Vocoder Model for Low Bit Rate Speech Coding, IEEE Trans. on Speech and Audio Processing, Vol.3, No.4, July 1995, pp.242–250. Although the reference has taken certain measures to decrease the effects of the buzzy-ness, it was only successive in part.

SUMMARY OF THE INVENTION

In consequence, it is an object of the present invention to improve speech quality by suppressing or otherwise rendering inaudible such buzzy-ness; the solution found has been to carefully apply noise to the speech signal. The necessary measures should require only relatively little processing effort, in view of the low-end character of LPC speech generation. Now, according to one of its aspects, the invention is characterized as recited in the characterizing part of claim 1. Both the spectrogram and human listener tests show the improvement.

The invention also relates to an apparatus for outputting speech so coded. Various further advantageous aspects of the invention are recited in dependent Claims.

BRIEF DESCRIPTION OF THE DRAWING

These and other aspects and advantages of the invention will be discussed more in detail hereinafter with reference to the disclosure of preferred embodiments, and in particular with reference to the appended Figures that show.

STATE OF THE ART REGARDING LPC

Speech generation has been disclosed in various documents, such as U.S. Ser. No. 08/326,791 (PHN 13801), U.S. Ser. No. 07/924,726 (PHN 13993), U.S. Ser. No. 08/696,431 (PHN 15408), U.S. Ser. No. 08/778,795 (PHN 15641), U.S. Ser. No. 08/859,593 (PHN 15819), all to the assignee of the present application.

Figure 1:
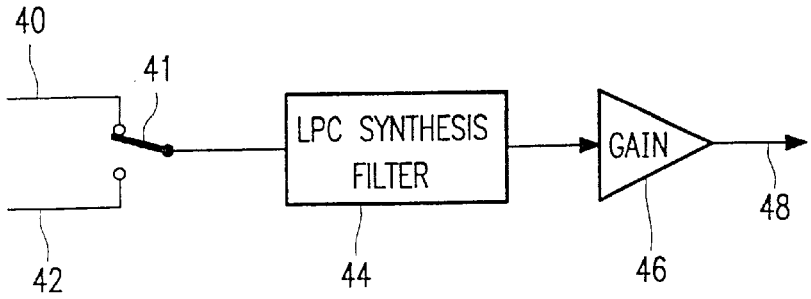
FIG. 1 PRIOR ART
FIG. 1, a classical monopulse vocoder.

FIG. 1 gives a classical monopulse or LPC vocoder. Advantages of LPC are its compact storage and the ease to manipulate speech so coded. A disadvantage is the relatively low quality of the speech produced. Conceptually, synthesis of speech is produced through all-pole filter 44 that can receive a periodic pulse train on input 40 and white noise on input 42. Selection is through switch 41, that controls the generating of a sequence of voiced and unvoiced frames. Amplifier 46 controls the ultimate speech volume on synthesized speech output 48. Filter 44 has time-varying filter coefficients. Typically, the parameters are updated every 5–20 milliseconds. The synthesizer is called mono-pulse excited, because there is only a single excitation pulse per pitch period. Generally, FIG. 1 represents a parametric model, and may use a large data base compounded for many applications. The invention may be implemented in a setup that has been modified relative to FIG. 1.

Figure 2:
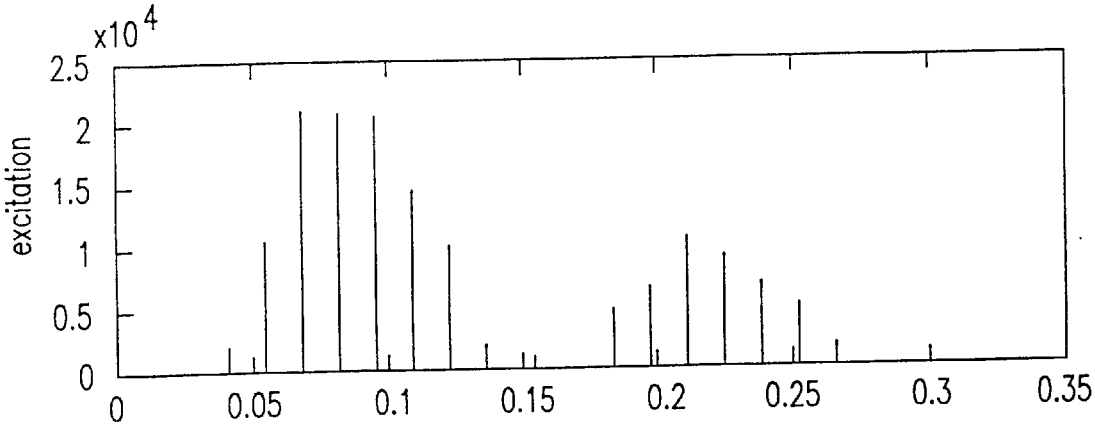
FIG. 2 PRIOR ART
FIG. 2, excitation signal of such vocoder.
Figure 3:
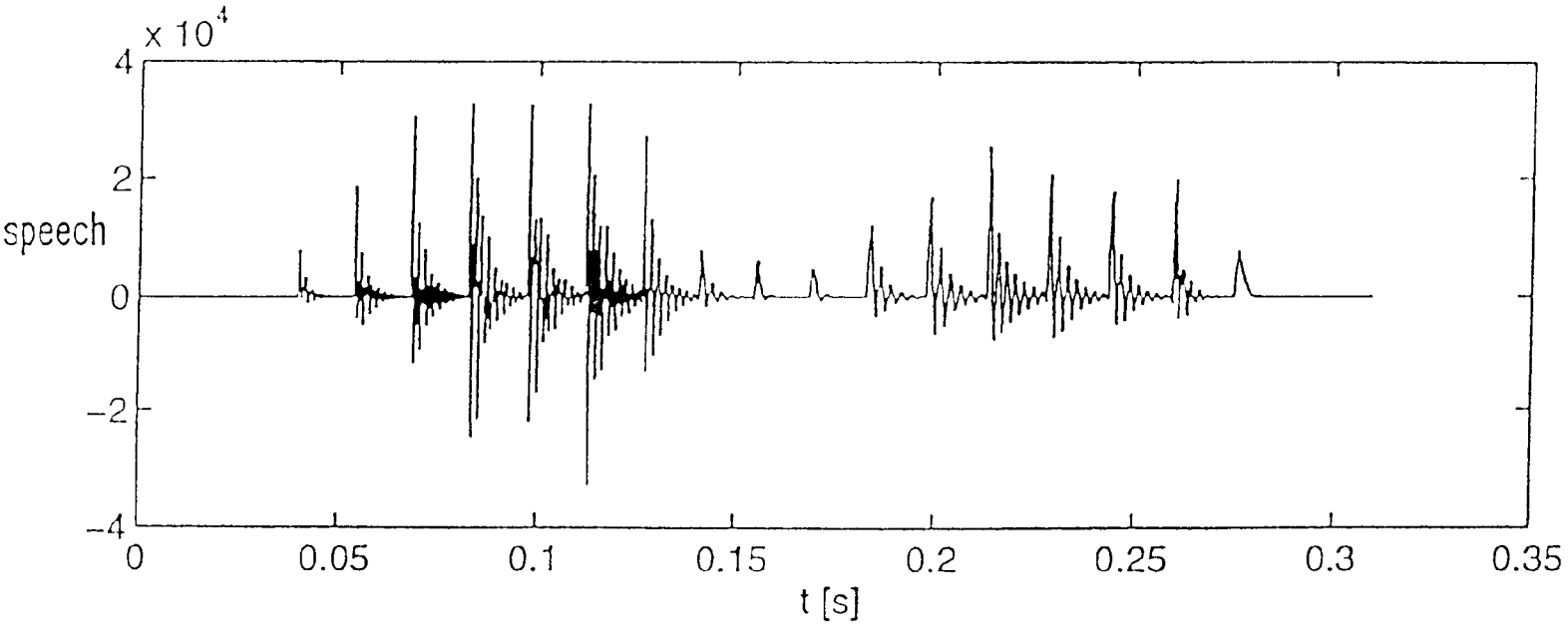
FIG. 3 PRIOR ART
FIG. 3, an exemplary speech signal generated thereby.

FIG. 2 shows an example of an excitation sequence to produce voiced speech with such vocoder and FIG. 3 an exemplary speech signal generated by this excitation. Time has been indicated in seconds, and instantaneous speech signal amplitude in arbitrary units.

Figure 4A:
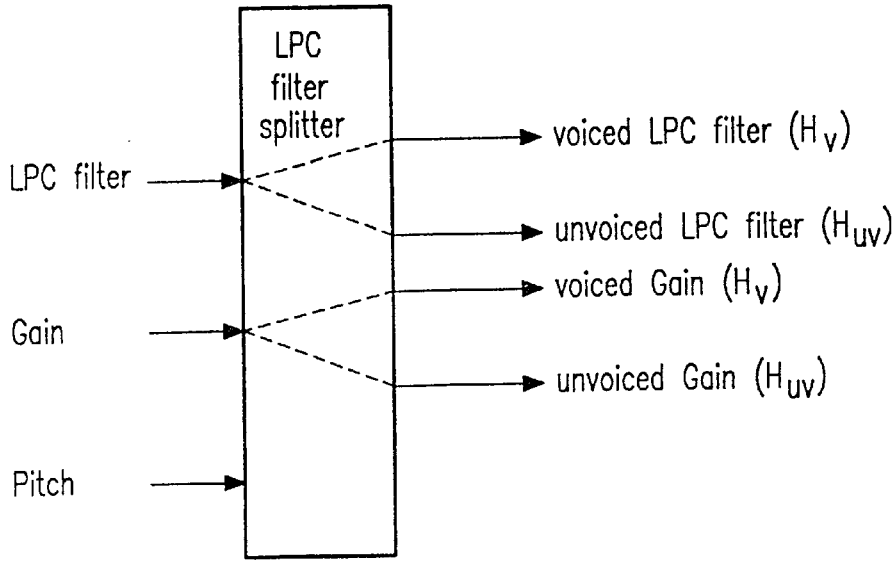
FIGS. 4A/B explain a proposed LPC-type vocoder.
Figure 4B:
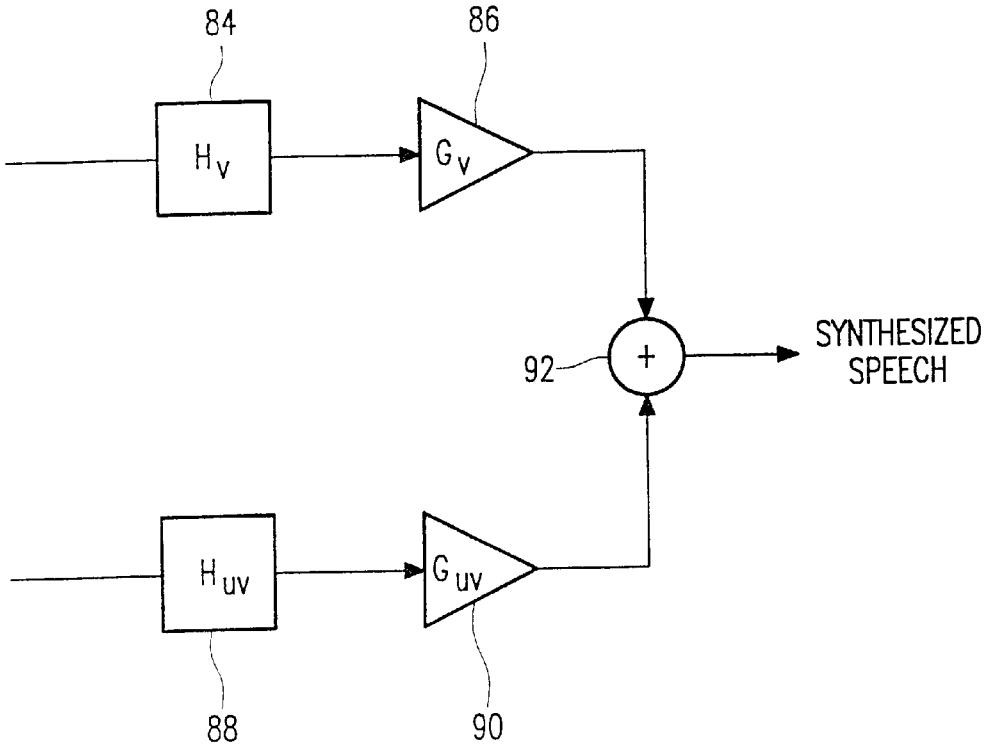

FIGS. 4A, 4B explain a proposed LPC-type vocoder. In particular, FIG. 4A conceptually shows the splitting of the LPC overall filter coefficients into a voiced filter $H_v$ and a separate unvoiced filter $H_{uv}$. Likewise, the overall gain is split into a voiced gain $G_v$ and a separate unvoiced gain $G_{uv}$. A controlling factor for executing the splitting is the pitch. Note that the conceptual block of this Figure is not a module in the eventual synthesizer; the splitting proper will be discussed hereinafter. FIG. 4B shows the vocoder synthesizer built from the separate voiced (84, 86) and unvoiced (88, 90) channels, that are added in element 92 to produce the synthesized output speech.

Figure 5:
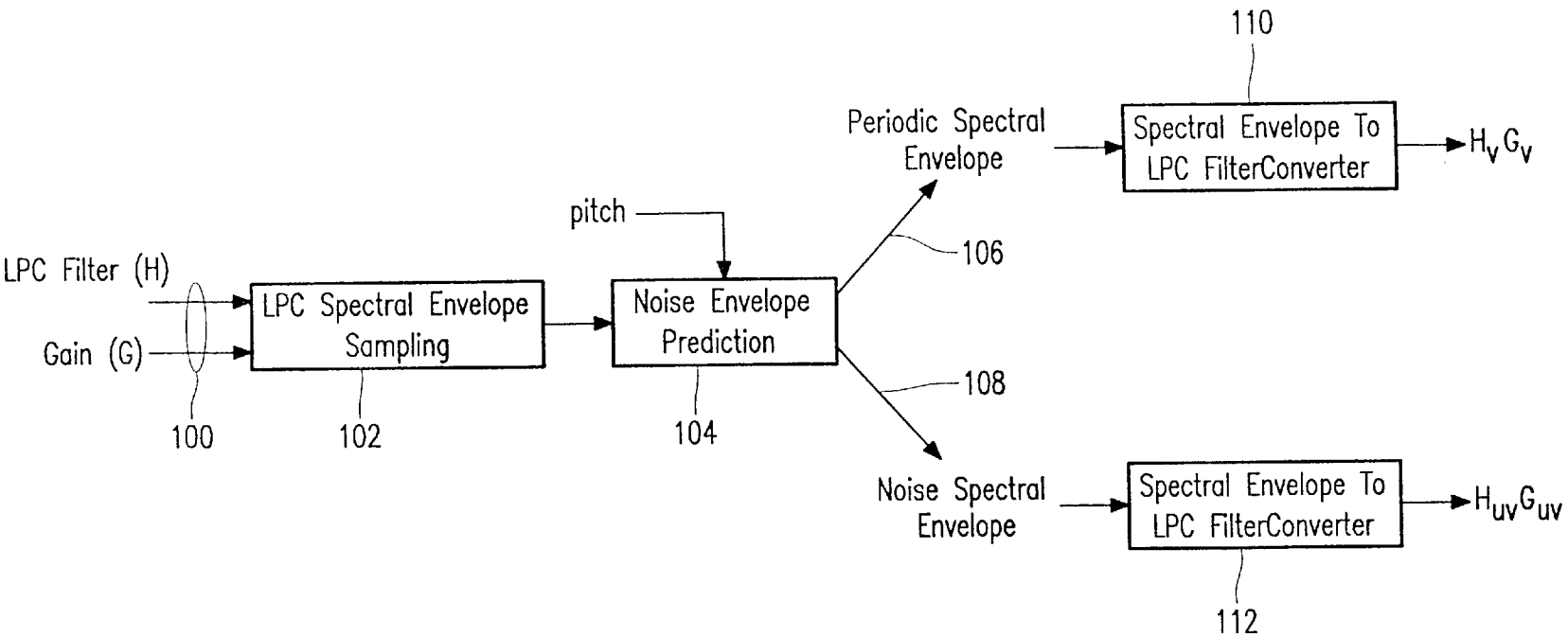
FIG. 5, a proposed LPC filter splitter.

FIG. 5 shows an LPC filter splitter according to the invention. The input from the original LPC filter has been labelled 100. Block 102 executes LPC spectral envelope sampling for translating to the frequency domain. This may be represented as sampling of harmonics, the associated phase being irrelevant. The fundamental sampling frequency in the frequency domain may be set to a fixed value $f_0$ such as 100 Hz. If the sampling rate in the time domain is 8 kHz, then the number of harmonics L=40. The value of $f_0$ should be high enough to avoid undersampling; it is independent of actual pitch frequency. The predictor order is p, and the number of the harmonic in question is k. The sampling is done according to $m_k=|A(z)^{-1}|_{z=2\pi k\cdot f0}$, where $A(z)=1+a_1z^{-1}+a_2z^{-2}+\ldots+a_pz^{-P}$.

The resulting harmonic amplitudes are fed into noise amplitude predictor 104 that is controlled by the pitch signal value. Block 104 produces two sets of harmonic amplitudes $m_{v,k}$ and $m_{uv,k}$ for voiced and unvoiced synthesis, respectively, in blocks 106, 108. These harmonic amplitudes are converted into autocorrelation functions using $$R[i] = \sum_{k=1}^{L} m_k^2 \cdot \cos(2\pi k f_0).$$

Computing LPC filter parameters from the autocorrelation functions is well-known by itself.

Figure 6:
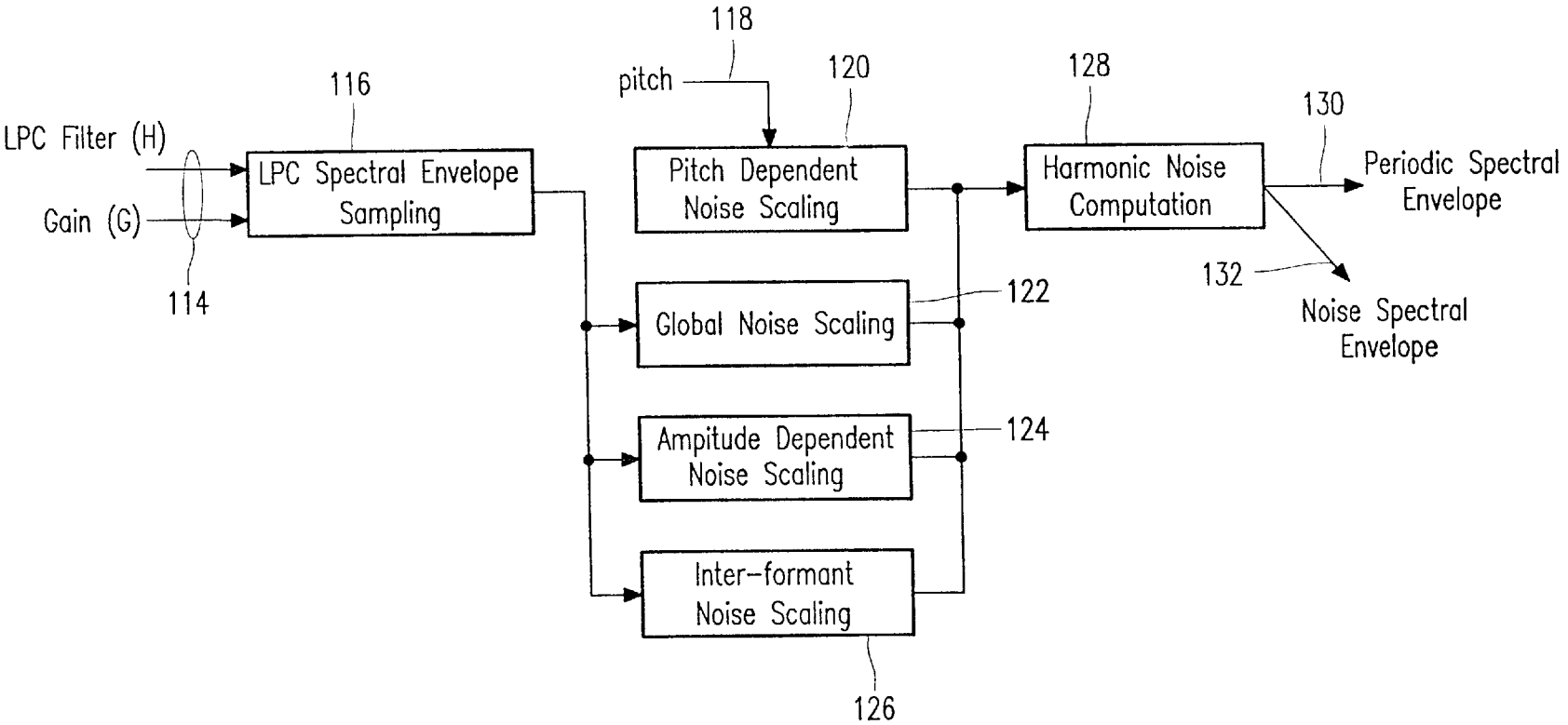
FIG. 6, a proposed noise envelope predictor.

FIG. 6 details the noise envelope predictor 104 of FIG. 5. The sampled shape of the all-pole filter inclusive of the wanted gain factor, instead of applying this factor at the output side, and furthermore the measured pitch are used to predict the amount of noise at each harmonic. As main cue for predicting the amount of noise we use the locations of the formant peaks. If the energy between two formant peaks is much lower than the global maximum peak, the speech in that region is found noisy. Also, if the pitch frequency is low, more noise is used according to the invention. Therefore, as shown in the Figure, the following four functional blocks control this amplitude: the Pitch Dependent Noise Scaling in block 120, the Global Noise Scaling in block 122, the Amplitude Dependent Noise Scaling in block 124, and the Inter-Formant Noise Scaling in block 126. The combined effects of these four blocks are presented in block 128 as the Harmonic Noise Computation, which completes the realization of block 104 in FIG. 5, to feed blocks 110, 112, with items The four effects in blocks 120, 122, 124, 126, may to an appreciable degree be considered mutually independent, but for optimum results they should be combined. Of course, scaling factors should be taken into account. The four effects are treated as follows:

1. Global Noise Scaling may be found through searching minimum harmonic amplitude $m_{min}$ and maximum harmonic amplitude $m_{max}$ within a given frequency interval such as 0–2 kHz. The dynamic range is then defined as $d=m_{max}/m_{min}$, and a global noise factor is then found as $n_g=\beta/(20\cdot\log^{10}(d))$. The scaling factor $\beta$ may be used to control the overall amount of noise for the synthesis, such as $\beta=5$. More noise will make the synthesized speech sound more hoarse.

2. Pitch Dependent Noise Scaling is found from the measured pitch as follows: $n_p=1/p$, which means that at low frequency noise is more predominant.

3. Amplitude Dependent Noise Scaling: the lower the amplitude of a particular harmonic $m_k$ in comparison to the global maximum Power $P_g$, the more noise may be used. A preferred expression for calculating this amplitude dependent noise scale is $n_{a,k}=(10\cdot\log^{10}P_g/20\cdot\log^{10}m_k)-1$.

Here, the final "1" indicates an offset value. Global power is calculated as follows. First, an immediately earlier power level $P_{g,prev}$ is multiplied by a relaxation value such as $\beta=0.99$ to let it decrease exponentially. If measured power is zero, the relaxation value is set to 0. Thus $P_g=\beta P_{prev}$. Then, the maximum power level from the sampled harmonic amplitudes is found: $P_m=\max\{m_k^{2\}, for}\ 1\leqq k\leqq L$. If $P_m$ is actually higher than $P_g$, $P_g$ is set equal to $P_m$.

4. Inter Formant Noise Scaling. Here, the locations of the formant tops are found from the harmonic amplitude spectrum. Using these locations, for each harmonic a value is calculated that gives the distance from the harmonic in question to the nearest formant peak: $D_k=|k_{top}-k|$, for the various tops 1 . . . k . . . L. The inter-formant noise scaling value is then found as the product of $D_k$ and $f_0$, where $f_0$ is the fundamental frequency used for sampling the harmonics: $n_{f,k}=D_k\cdot f_0$.

Advantageously, the four noise scales so found are combined to give the amount of noise at harmonics above a certain frequency: $n_k=0$ for $k<3$, but $n_k=n_g\cdot n_p\cdot n_{a,k}\cdot n_{f,k}$ for higher values. The two lowest harmonics are presumed to have no noise in the embodiment. However, the value of k used may be higher or lower, even k=0. If the value for $n_k$ so found is greater than 1, it is thresholded to 1. In certain situations, another arithmetic combination than full multiplication may produce a similarly useful result. In fact, it appears that often a lower number than four of the effects combined may produce agreeable results as well.

Finally, for each harmonic an amplitude $m_{k,uv}$ is determined for the unvoiced envelope by $m_{k,uv}=m_k\cdot n_k$, and the voiced harmonic amplitude becomes $m_{v,k}=m_k-m_{uv,k}$, because the sum of the two quantities must remain the same. Alternatively, once the harmonic noise spectrum has been found, one may also use sinusoidal synthesis to produce the output signal. A harmonic oscillator bank may be used with harmonic amplitudes sampled from the LPC filter and furthermore, the phase may be set to a combination of an initial phase and a random phase, depending on the predicted noise at that frequency. The initial phases may be controlled by a function like $2\pi\cdot(k-0.5)/k$ with k again the number of the harmonic, to smear out the energy over time. An advantage of the latter scheme is that phase manipulation is an attractive speech-shaping mechanism.

Figure 7:
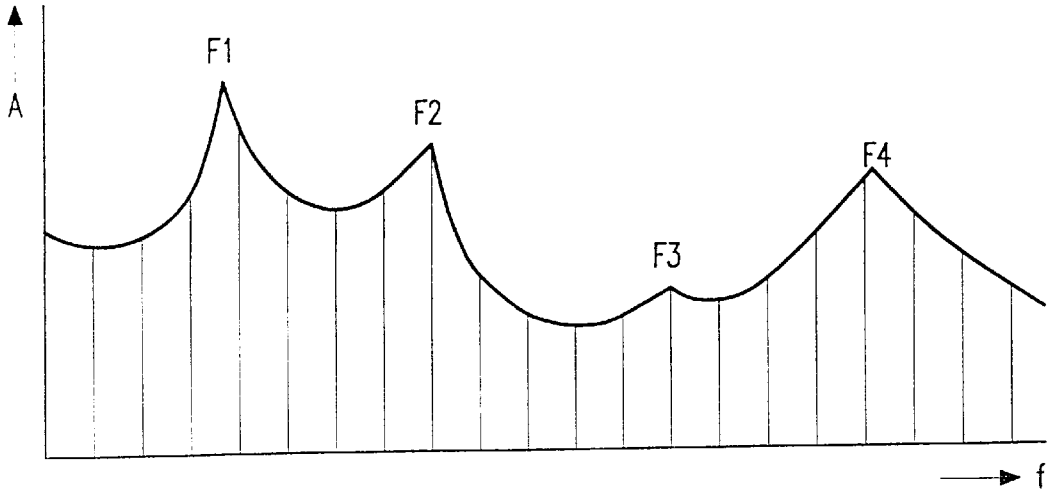
FIG. 7, a spectrum of exemplary speech.

FIG. 7 gives a spectrum of exemplary speech. Here, the so-called formant frequencies are separated from each other by valleys. The equidistant vertical lines indicate sample frequencies. For processing, the speech is commonly windowed through a time-series of mutually overlapping window-functions. The processing is generally based on an isolated window, the results of the processing then being accumulated again on the basis of mutually overlapping time-windows. By taking such a relatively brief time period, cost is kept low. One of the recognitions leading to the invention is that noise effects are primarily relevant in the valleys between the formant frequencies, and also that the effects are more relevant at higher frequencies. Much of the design used hereinafter is centred on attaining an optimum distribution of the noising over the voiced spectrum.

Figure 8A:
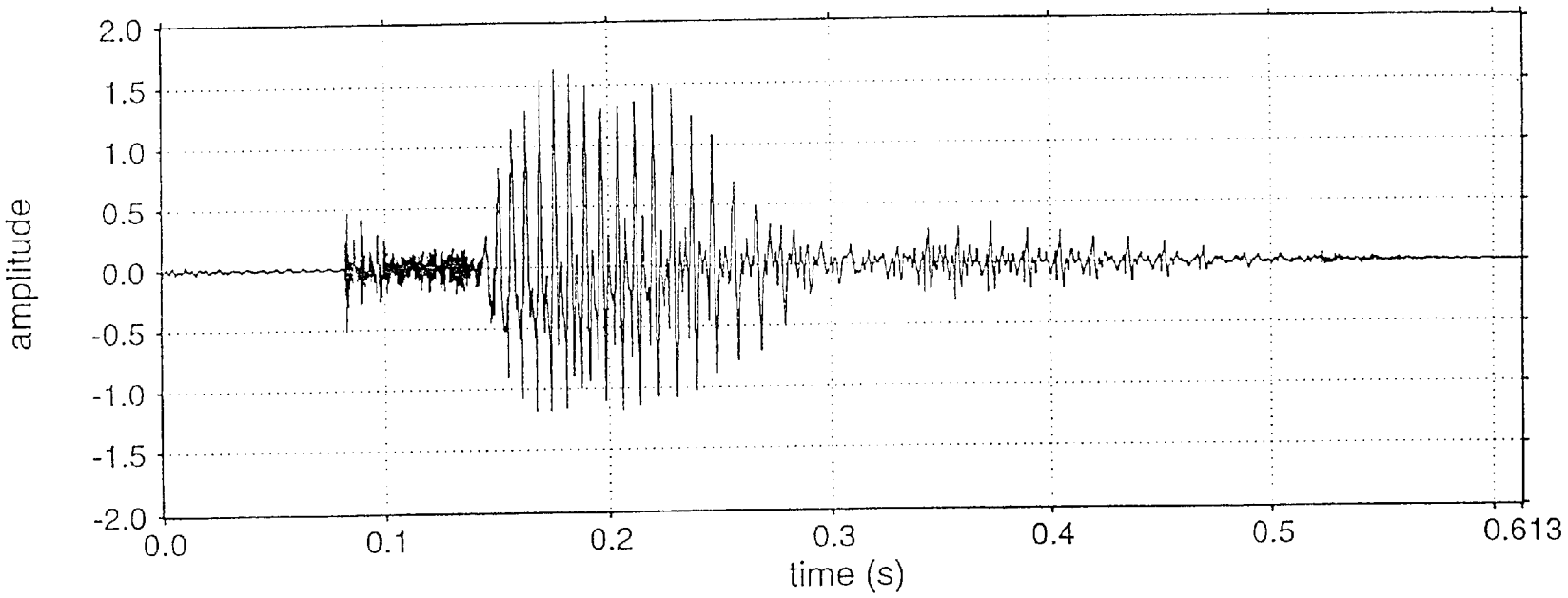
FIGS. 8A/B, a speech signal and its spectrogram.
Figure 8B:
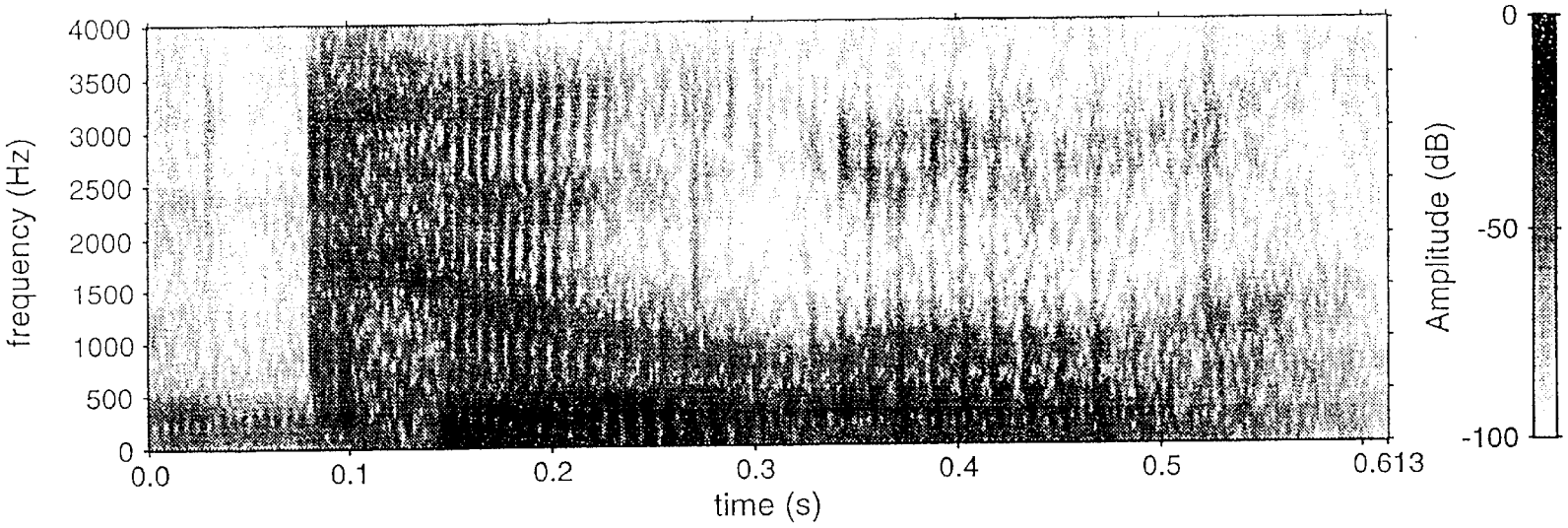

FIG. 8A shows a natural speech signal and FIG. 8B its spectrogram. The phonetic meaning of the utterance has been ignored. Three different types of speech are visible, with the middle one the most clearly relating to voiced speech. As also seen, voiced speech has successive vertical bands.

Figure 9A:
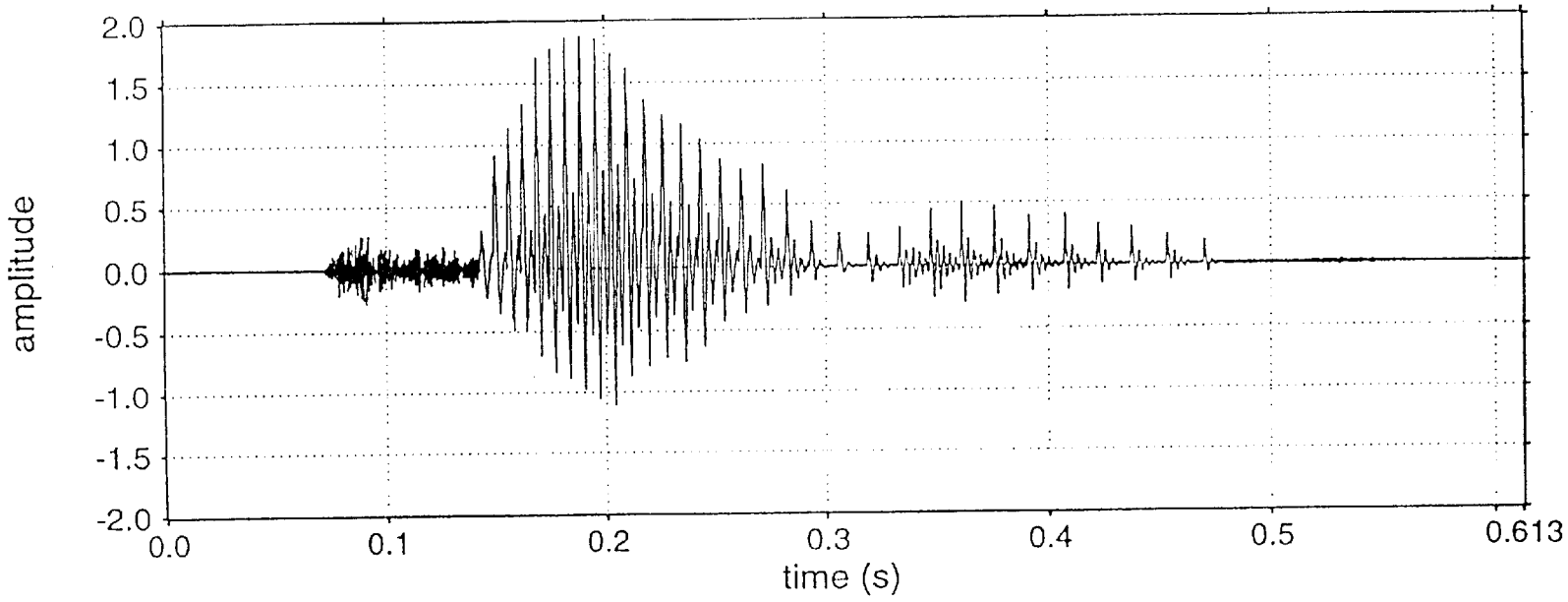
FIGS. 9A/B, an LPC signal and its spectrogram.
Figure 9B:
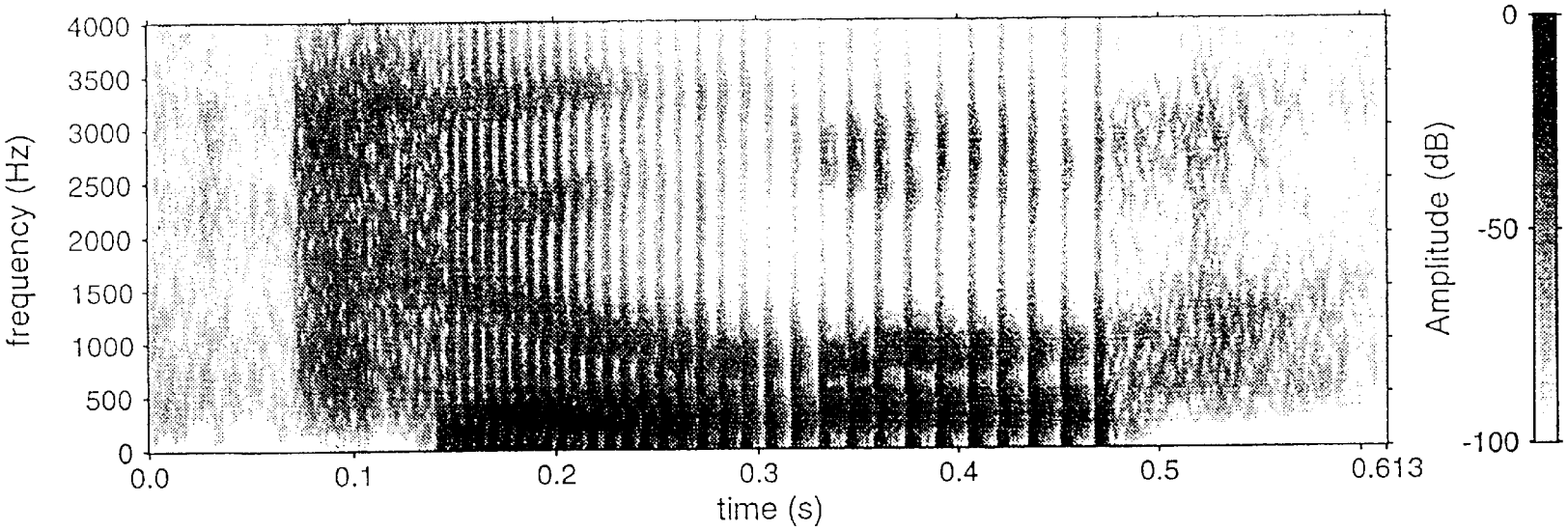

FIGS. 9A/B in the same manner show an LPC signal and associated spectrogram, without applying the improvement according to the invention. As long as speech is voiced, the vertical bands are much more prominently visibly than in FIG. 10B; in fact the onset and termination thereof appear to be quasi-instantaneous. In fact, these bands have been linked to the buzzy-ness referred to earlier.

Figure 10A:
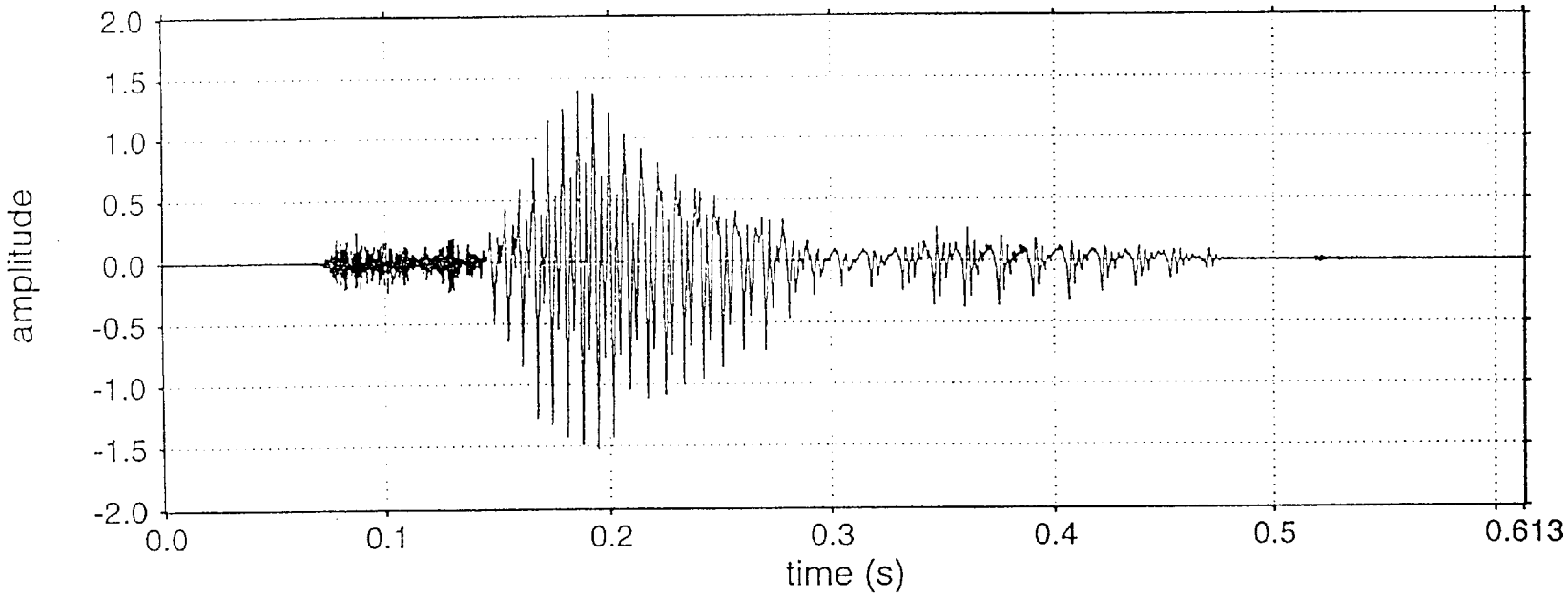
FIGS. 10A/B, the same improved with the invention.
Figure 10B:
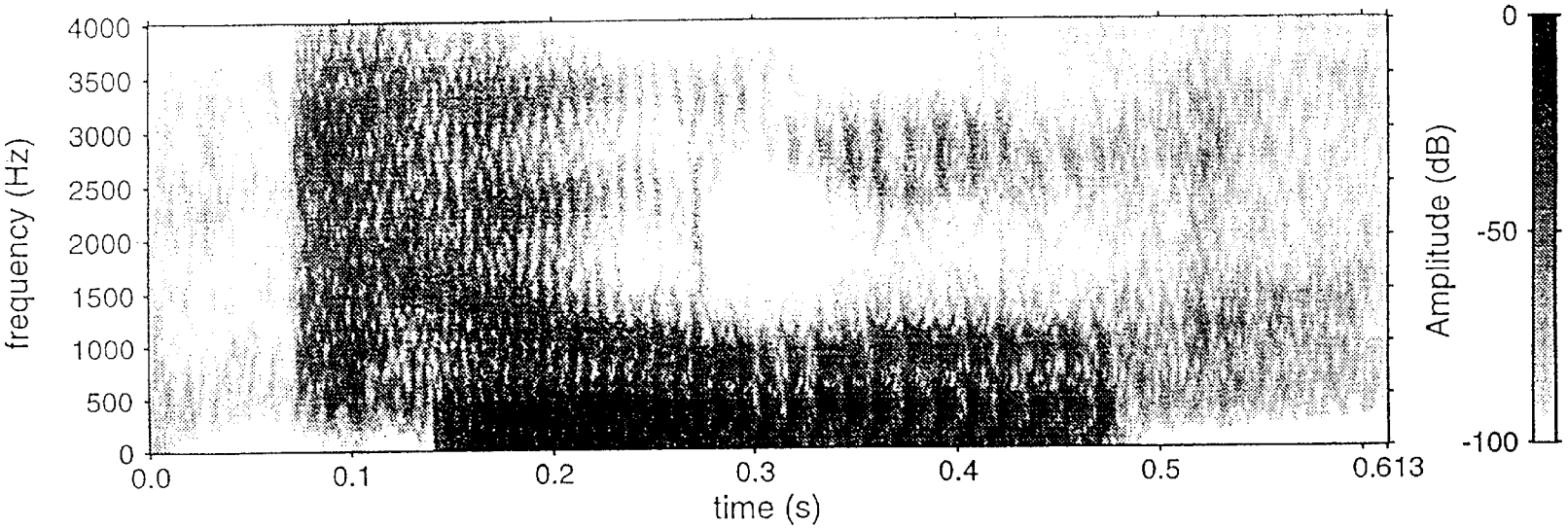

FIGS. 10A/B show again the audio output and its reconstructed spectogram, after the audio had been improved with the invention, to wit, by phase-randomizing particular harmonics as governed by the relative intensities of the noise. The vertical dark bands have about the same intensity as in the original, and their onset and termination are less instantaneous.

What is claimed is:

1. A method comprising:

receiving a sequence of speech segments that are coded according to an LPC principle;

reproducing said segments for in audio reproduction, wherein said reproducing step includes, exciting an all-pole filter with recurrent signals in case of voiced speech, and exciting the all-pole filter with white noise in case of unvoiced speech;

wherein said recurrent signals are represented by a series of periodic signals, that said recurrent signals are supplemented by noise from a source for filtering through an amended LPC filter derived from the LPC-filter by using information of pitch, the amended LPC filter characteristics are determined using at least a subset of the four quantities Global Noise Scaling, Pitch Dependent Noise Scaling, Amplitude Dependent Noise Scaling, and Inter-Formant Noise Scaling of a signal.

2. A method as claimed in claim 1, wherein said noise depends on all said four quantities combined.

3. A method as claimed in claim 1, wherein said noise is determined by multiplying any said quantity figuring in the subset.

4. A method as claimed in claim 1, wherein an interformant noise scaling for each element of said series is used, which uses the formant peaks of a signal's harmonic amplitude spectrum.

5. A method as claimed in claim 1, wherein said actual spectrum is compared to a threshold that relaxates.

6. A method as claimed in claim 4, wherein said noise has a maximum phase difference of $2\pi$.

7. A method as claimed in claim 4, wherein values from said voiced speech are supplemented with values of said noise further include the steps of, standardizing power levels of respective speech harmonics;

calculating a pitch-dependent noise factor calculating a harmonic peak-dependent attenuation pattern calculating a harmonic peak dependent noise factor randomizing a harmonic-dependent phase shift reconstructing a speech signal using initial phase patterns, random noise patterns, and amplitude scalings for each harmonic respectively.

8. An apparatus being arranged for LPC coding a sequence of speech segments, the apparatus comprising:

an LPC filter;

an all-Dole filter coupled to said LPC filter for reproducing said segments for in audio reproduction, by exciting an amended LPC filter with recurrent signals in case of voiced speech, and exciting the amended LPC filter with white noise in case of unvoiced speech;

wherein said recurrent signals are represented by a series of periodic signals, that said recurrent signals are supplemented by noise from a source for filtering through the amended LPC filter derived from the LPC-filter by using information of pitch, the amended LPC filter characteristics are determined using at least a subset of the four quantities Global Noise Scaling, Pitch Dependent Noise Scaling, Amplitude Dependent Noise Scaling, and Inter-Formant Noise Scaling of a signal.

* * * * *